US010330353B2

(12) United States Patent
Keleshian et al.

(10) Patent No.: US 10,330,353 B2
(45) Date of Patent: Jun. 25, 2019

(54) ENERGY EFFICIENT COLD STORAGE UNITS

(71) Applicant: ZEROENERGY BUILDINGS, INC., Guilderland, NY (US)

(72) Inventors: K. George Keleshian, Guilderland, NY (US); Suresh Krishnaji Bhate, Schenectady, NY (US)

(73) Assignee: ZEROENERGY BUILDINGS, INC., Guilderland, NY (US)

( * ) Notice: Subject to any disclaimer, the term of this patent is extended or adjusted under 35 U.S.C. 154(b) by 0 days.

(21) Appl. No.: 15/822,978

(22) Filed: Nov. 27, 2017

(65) Prior Publication Data

US 2018/0135898 A1 May 17, 2018

Related U.S. Application Data

(63) Continuation of application No. 14/441,391, filed as application No. PCT/US2013/068927 on Nov. 7, 2013, now Pat. No. 9,829,222.

(Continued)

(51) Int. Cl.
*F25B 5/04* (2006.01)
*F25B 27/00* (2006.01)

(Continued)

(52) U.S. Cl.
CPC ..... *F25B 27/00* (2013.01); *F25B 5/04* (2013.01); *F25B 6/00* (2013.01); *F25D 11/006* (2013.01);

(Continued)

(58) Field of Classification Search
CPC ..... F25B 27/00; F25D 21/04; F25D 23/06; F25D 23/025; F25D 21/14; F25D 2321/1412
See application file for complete search history.

(56) References Cited

U.S. PATENT DOCUMENTS 3,850,006 A 11/1974 Redfern et al.
4,367,633 A 1/1983 Strathman (Continued)

FOREIGN PATENT DOCUMENTS

WO 03044439 5/2003
WO 2008127344 10/2008

OTHER PUBLICATIONS

International Search Report for PCT/US2013/068927 dated Mar. 14, 2014.

(Continued)

*Primary Examiner* — Ana M Vazquez
(74) *Attorney, Agent, or Firm* — Heslin Rothenberg Farley & Mesiti P.C.

(57) ABSTRACT

Cold storage unit apparatuses designed for high energy efficiency are provided, which may include: a refrigeration system; a box enclosing an interior space, the box formed by a plurality of insulated sides; an entry into the interior space including a plurality of openable barriers facilitating preventing entry of heat or moisture into the interior space; and a power system connected to the refrigeration system, the power system facilitating independent operation of the refrigeration system when not connected to a power grid, and further facilitating a net energy use of zero from a power grid when connected to a power grid. Cold storage units may further include systems for using the refrigerant of the refrigeration system to defrost one or more components of the cold storage unit, and for using the refrigerant to facilitate maintaining a desired internal temperature of the interior space of the cold storage unit.

20 Claims, 5 Drawing Sheets

Related U.S. Application Data

(60) Provisional application No. 61/723,530, filed on Nov. 7, 2012.

(51) Int. Cl.

| | |
|---|---|
| ***F25B 6/00*** | (2006.01) |
| ***F25D 29/00*** | (2006.01) |
| ***F25D 13/00*** | (2006.01) |
| ***F25D 17/00*** | (2006.01) |
| ***F25D 21/14*** | (2006.01) |
| ***F25D 23/02*** | (2006.01) |
| ***F25D 23/06*** | (2006.01) |
| ***F25D 11/00*** | (2006.01) |
| ***F25D 21/04*** | (2006.01) |

(52) U.S. Cl.

CPC ..... *F25D 13/00* (2013.01); *F25D 17/005* (2013.01); *F25D 21/04* (2013.01); *F25D 21/14* (2013.01); *F25D 23/025* (2013.01); *F25D 23/06* (2013.01); *F25D 29/00* (2013.01); *F25D 2303/0844* (2013.01); *F25D 2321/1412* (2013.01)

(56) References Cited

U.S. PATENT DOCUMENTS

| | | | | |
|---|---|---|---|---|
| 5,431,490 | A | 7/1995 | Edwards | |
| 2003/0230104 | A1 | 12/2003 | Morse | |
| 2011/0140649 | A1 | 6/2011 | Choi | |
| 2012/0311926 | A1* | 12/2012 | Mittelmark ..... | F24F 3/16 47/17 |

OTHER PUBLICATIONS

"Better ENERGY Solutions Today Contained Energy Solar Powered Cold Storage Systems," retrieved from the internet: URL: http://web.archive.org/web/20120822040334/http://www.containedenergy.com/CE Solar_Powered_Cold_Storage_System_1.01.pdf, Aug. 22, 2012.

Julian Milnes; "Solar power cold storage launched—News—Refrigeration and Air Conditioning," retrieved from the internet: URL: http://www.racplus.com/news/solar-powered-cold-storage-launched/8633815.article, Jul. 30, 2012.

"Solar Refrigeration," retrieved from the interne: URL: http://web.archive.org/web/20110407172812/http://www.containedenergy.com/html/solar_refrigeration.html, Apr. 7, 2011.

* cited by examiner

ENERGY EFFICIENT COLD STORAGE UNITS

CROSS REFERENCE TO RELATED APPLICATIONS

This application is a Continuation of National Stage application Ser. No. 14/441,391 filed on May 7, 2015, based on International Application PCT/US2013/068927 filed on Nov. 7, 2013, published as WO 2014/074703 A1 on May 15, 2014. This application also claims priority to U.S. Provisional Application No. 61/723,530 filed on Nov. 7, 2012, both of which are incorporated herein by reference.

FIELD OF THE INVENTION

The present invention relates generally to cold storage units, and more specifically to cold storage units capable of operating on an independent power source that allows for the cold storage unit to run independently of a power grid, or alternatively for the cold storage unit to run on both an independent power source and a power grid so that the cold storage unit may draw a net of zero energy from the power grid.

BACKGROUND

Cold storage units, including walk-in coolers and freezers, have been in use for many years and have a wide variety of applications. Such units usually require a large amount of energy to operate, as the refrigeration system requires electrical energy to run a condenser, compressor, evaporator, and other components. Many refrigeration systems must operate frequently in order to maintain a desired temperature inside the storage unit, as heat may naturally enter the unit through opening doors into the storage unit, through thermal contact with a warmer external environment, and so on. Freezer units generally require even more electrical energy to operate than coolers, not only because the desired internal temperature of the unit is usually much lower than the external environment temperature, but also because additional energy is usually required to keep certain components of the freezer from undesirable freezing and icing, such as the freezer door and moisture draining system.

In most applications, cold storage units must draw their energy from an external power grid, such as a power grid system operated by a utility company. The large amounts of energy needed to operate a cold storage unit may thus translate into a large expense for any individual or business operating such a unit. Higher efficiency cold storage units may help in reducing the amount of power needed from a power grid to operate a refrigeration system, but ideally this dependence could be eliminated or reduced such that the refrigeration system could essentially draw a net energy of zero from a power grid, as for example where an independent power source operates the refrigeration system and feeds excess generated power back to the external power grid. The dependence on an external grid poses other potential problems as well. For example, during extended power outages, power may not be available from external power grids to run a refrigeration system, leading to possible spoilage of goods stored inside the unit.

Thus, there is a continuing need for the development of higher efficiency cold storage units that can operate independently of a power grid, and for cold storage units that can operate in conjunction with a power grid to draw a net zero of energy from such power grids.

SUMMARY OF THE INVENTION

The shortcomings of the prior art are overcome and additional advantages are provided through the provision, in one aspect, of an apparatus comprising a cold storage unit capable of being connected to a power grid, the cold storage unit comprising: a refrigeration system; a box enclosing an interior space, the box comprising a plurality of insulating sides, the insulating sides minimizing heat transfer and moisture transfer to the interior space from an external environment; an entry into the interior space comprising a plurality of openable barriers, the plurality of barriers facilitating preventing entry of heat or moisture into the interior space from the external environment; and, a power system connected to the refrigeration system, the power system facilitating independent operation of the refrigeration system when not connected to a power grid, and further facilitating a net energy use of zero from a power grid when connected to the power grid.

In another aspect, the apparatus further comprises: a plurality of tubes facilitating conveyance of refrigerant in the refrigeration system to one or more components of the cold storage unit, the refrigerant facilitating defrosting of the one or more components of the cold storage unit; and, at least one container comprising an enclosed volume and a freezable material, the container facilitating maintaining a below-freezing temperature within the interior space.

Additional features and advantages are realized through the techniques of the present invention. Other embodiments and aspects of the invention are described in detail herein and are considered a part of the claimed invention.

BRIEF DESCRIPTION OF THE DRAWINGS

One or more aspects of the present invention are particularly pointed out and distinctly claimed as examples in the claims at the conclusion of the specification. The foregoing and other objects, features, and advantages of the invention are apparent from the following detailed description taken in conjunction with the accompanying drawings in which:

DETAILED DESCRIPTION

Figure 1A:
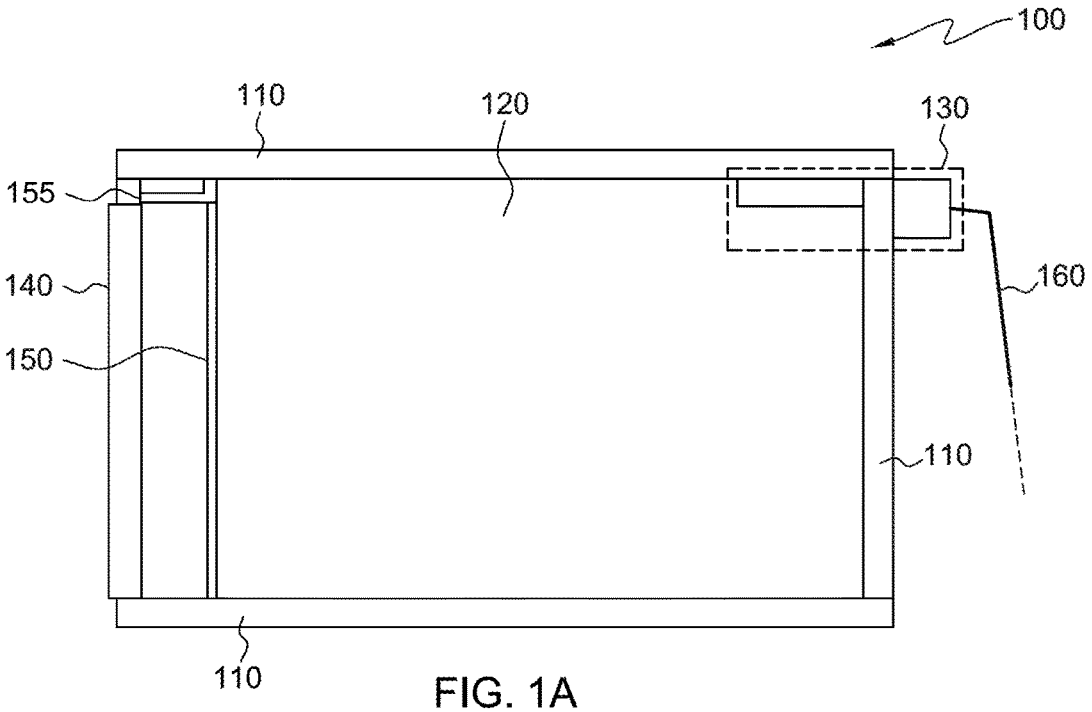
FIG. 1A depicts a cut-away side view of an embodiment of a cold storage unit box with a refrigeration system and a plurality of openable barriers, in accordance with one or more aspects of the present invention.

Aspects of the present invention and certain features, advantages, and details thereof, are explained more fully below with reference to the non-limiting examples illustrated in the accompanying drawings. Descriptions of well-known materials, fabrication tools, processing techniques, etc., are omitted so as not to unnecessarily obscure the invention in detail. It should be understood, however, that the detailed description and the specific examples, while indicating aspects of the invention, are given by way of illustration only, and are not by way of limitation. Various substitutions, modifications, additions, and/or arrangements, within the spirit and/or scope of the underlying inventive concepts will be apparent to those skilled in the art from this disclosure.

Generally stated, provided herein, in one aspect, is an apparatus comprising a cold storage unit capable of being connected to an external power grid. The cold storage unit includes, for instance: a refrigeration system; a box enclosing an interior space, the box comprising a plurality of insulating sides, the insulating sides minimizing heat transfer and moisture transfer to the interior space from an external environment; an entry into the interior space comprising a plurality of openable barriers, the plurality of barriers facilitating preventing entry of heat or moisture into the interior space from the external environment; and a power system connected to the refrigeration system, the power system facilitating independent operation of the refrigeration system when not connected to a power grid, and further facilitating a net energy use of zero from a power grid when connected to the power grid. In one embodiment, the apparatus may further comprise a plurality of tubes that convey heated refrigerant from a compressor of the refrigeration system to one or more components of the cold storage unit, such as an entry frame for one of the openable barriers or a moisture drainage system, and one or more containers through which cold refrigerant may be conveyed out of an evaporator and back to the compressor, the containers holding a freezable material that freezes as cold refrigerant passes through the container, and the frozen material facilitating maintaining a desired temperature inside the cold storage unit.

In one or more embodiments, the cold storage unit may further achieve operation of the refrigeration system independent from an external power grid. Cold storage units, to be of value, should be able to maintain a desired temperature inside the unit to prevent stored items from spoiling, such as food items or medical supplies. Generally, the desired temperature is maintained, in large part, by frequent operation of a refrigeration system to transfer heat out of the cold storage unit to an external environment. Such frequent operation may, without additional efficiency improvements, require energy and power that cannot be adequately supplied by an independent power source, such as a solar panel system. Reducing the energy required to operate the refrigeration system may allow for use of an independent power supply to operate the cold storage unit independently of an external power grid. In turn, reducing the energy needed to operate the refrigeration system may possibly be achieved by minimizing, to the greatest extent possible, the transfer of heat and moisture from an external environment into the cold storage unit interior, such as by providing higher levels of insulation around the interior, by blocking heat and moisture transfer when the cold storage is opened, and so on. The apparatuses disclosed herein provide, in part, cold storage units that may achieve an energy efficiency necessary to operate a refrigeration system with an independent power supply and independent from an external power grid.

In another one or more embodiments, the cold storage unit may further achieve operation of the refrigeration system via an independent power supply and an external power grid, in which the independent power supply is capable of transmitting excess generated power to the external power grid. In circumstances where complete independence from an external power grid is not possible or not desirable, the cold storage unit may be connected both to an independent power supply and an external power grid, so that when the independent power supply is unable to adequately power the refrigeration system the external power grid connection may supply power to the refrigeration system. However, reducing the amount of power drawn from an external power grid may still be desirable, in part, because of the costs of using power from an external power grid. Reducing the energy required to operate the refrigeration system may thus facilitate reducing the power drawn from an external power grid. An independent power supply may further reduce the net amount of energy required from an external power grid. Furthermore, the independent power supply may be capable of transmitting excess generated power back to the external power grid, so that the "net energy" drawn from an external power grid is reduced to zero or even lower. This may be possible when the energy efficiency of the cold storage unit reduces the amount of electric power needed to run the refrigeration system, thus reducing both the amount of power required from an external power grid and the amount of power required from the independent power supply. The apparatuses disclosed herein provide, in part, cold storage units that may achieve an energy efficiency that allows for operation of a refrigeration system using both an independent power supply and a connection to an external power grid, in which the independent power supply may also generate excess power to be transmitted to the external power grid.

Reference is made below to the drawings, which are not drawn to scale for ease of understanding, wherein the same reference numbers used throughout different figures designate the same or similar components.

FIG. 1A depicts a cut-away side view of one embodiment of a cold storage unit 100. The cold storage unit includes a plurality of sides 110 that form a box enclosing an interior space 120. In the embodiment depicted, each side 110 of the box is an insulating side, providing insulation to interior space 120 to minimize the transfer of heat and moisture from an external environment into interior space 120. Insulation may be provided, for example, by an insulating material, such as polyurethane insulation, of a particular thickness designed to provide a desired insulation rating. For instance, the cold storage unit may be a cooler designed to maintain an interior temperature of about 35° F. to 40° F., but usually not lower than about 32° F.; in this instance, the insulating sides may include, for example, panels containing about six inch thick polyurethane insulation, which may provide an insulation at a rating of about R-50 or greater. Insulating sides providing insulation at a rating of about R-50 may provide about two times the insulation capability over four-inch thick R-32 insulating sides, which may be commonly used in other cooler units. In another example, the cold storage unit may be a freezer designed to maintain an internal temperature below 32° F., possibly around 0° F. or lower; in this instance, the insulating sides may include, for example, panels containing about eight inch thick polyurethane insulation, which may provide an insulation at a rating of about R-68 or greater. The insulation may also be provided by alternate materials or even alternative insulation systems, such as a vacuum system designed to actively remove heat from the sides of the cold storage unit. Alternative materials or systems of insulation may provide an effective insulation similar to the rating of solid insulation materials such as polyurethane insulation, as described above. Although other types and ratings of insulating sides may be used in forming the box component of the cold storage unit, it should be understood that the use of insulated sides with greater insulation capabilities, as described or in alternative examples, may better facilitate the maintenance of the desired internal temperature of interior space 120, and therefore may facilitate reducing the total amount of power drawn by a refrigeration system to reduce or maintain the temperature of interior space 120.

FIG. 1A also depicts an embodiment of a portion of a refrigeration system 130, shown here in one possible location. Some components of refrigeration system 130 may be disposed within the interior space 120 for the system to reduce the air temperature inside the interior space 120, while other components of refrigeration system 130 may be disposed externally for dissipation of heat and for other functions. An electrical power connection 160 connects refrigeration system 130 to a power source (not depicted in this figure). It should be understood that the location of refrigeration system 130 depicted is only one preferred location, and in other embodiments the refrigeration system or certain components of the refrigeration system may be located elsewhere.

FIG. 1A also depicts an embodiment of an entry into cold storage unit 100, including a plurality of openable barriers. The entry depicted includes a first openable barrier 140 that provides the main entry to interior space 120 from an external environment. The first openable barrier 140 may preferably be an insulated door that provides about the same insulation capability as the insulating sides 110 of the cold storage unit. Thus, for example, where the sides 110 provide insulation of a rating about R-68, as may be used for a freezer unit, entry door 140 ideally provides about the same insulation of rating R-68. The entry further includes a second openable barrier 150 that is disposed within the interior space 120 of the cold storage unit 100 to facilitate preventing heat and moisture from an external environment from entering interior space 120. Use of only a single entry barrier, such as an exterior door, may not adequately block the entry of heat and moisture when the entry barrier is opened, as the opening permits immediate contact between the external environment and interior space 120. A second barrier 150 facilitates preventing such contact between the interior space 120 and external environment if it remains closed when the first entry barrier 140 is opened, and second barrier 150 is not opened until first entry barrier 140 is closed again. Thus, by making use of an entry system with a plurality of openable barriers, the amount of undesired heat and moisture that enters the cold storage unit when opened may be reduced, consequently reducing any rise in temperature in the interior space and reducing the need to draw electrical power to operate the refrigeration system. The second barrier 150 may be supported by a support structure 155 to hold the second barrier in place. Several possible second barrier 150 embodiments are possible. For example, second barrier 150 may be a plurality of overlapping strips, which may be made of poly-vinyl chloride (PVC) or other similar material, suspended from a support structure 155 attached to a ceiling side of cold storage unit 100. In another example, second barrier 150 may be a second insulated door, supported by a frame or wall or other support structure 155. Other embodiments of an entry with a plurality of openable barriers, as well as other embodiments of a first entry barrier and a second entry barrier, are also possible and are contemplated as being within the scope of the present disclosure.

Figure 1B:
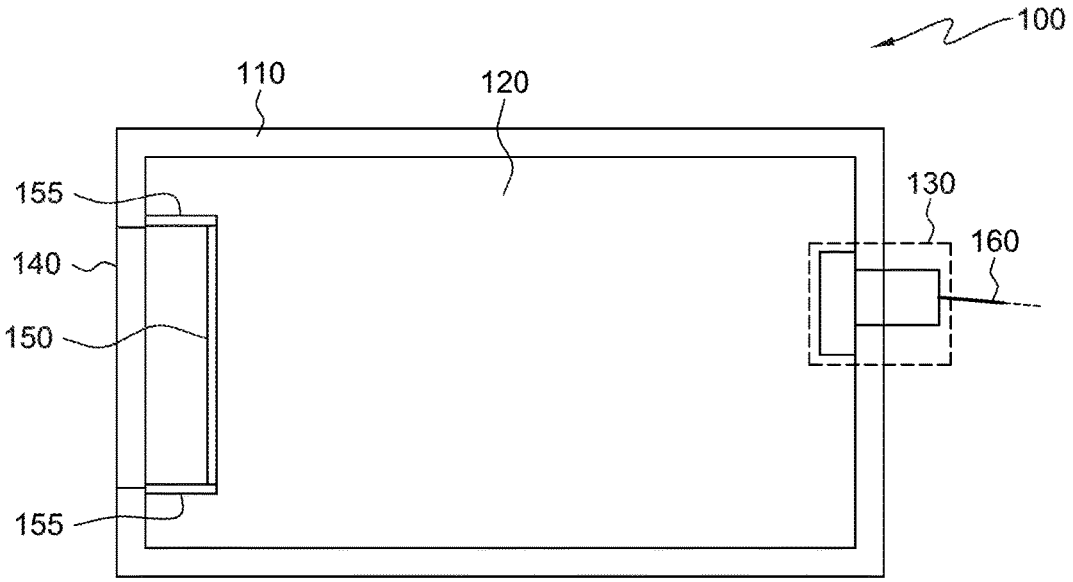
FIG. 1B depicts a cut-away top view of an embodiment of a cold storage unit box with a refrigeration system and a plurality of openable barriers, in accordance with one or more aspects of the present invention.

FIG. 1B depicts a cut-away top view of an embodiment of a cold storage unit 100 similar to the embodiment depicted in FIG. 1A, here with the side that forms the top or ceiling of the cold storage unit removed. The elements depicted in this figure are similar to those described for FIG. 1A, and are depicted here by way of example to illustrate one possible arrangement of a refrigeration system 130, first entry barrier 140, second entry barrier 150, and support structure 155 as viewed from above cold storage unit 100.

Figure 2A:
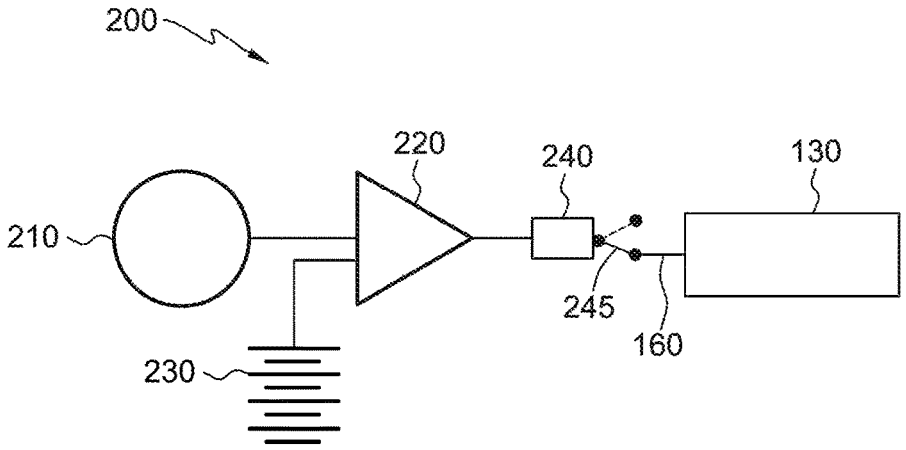
FIG. 2A depicts an embodiment of a power system connected to a refrigeration system, in which the power system and refrigeration system are designed to operate independent of an external power grid, in accordance with one or more aspects of the present invention.

FIG. 2A provides a schematic illustration of an embodiment of a power system 200 connected to a refrigeration system 130 of a cold storage unit as described herein. In this embodiment, power system 200 is designed to operate refrigeration system 130 independently, without reliance on an external power grid. Power system 200 includes a power source 210 that may generate electrical energy and supply said energy to a refrigeration system 130. Power source 200 may be one or more of several types of independent power sources. For example, power source 210 may be one or more photovoltaic (solar) panels capable of converting light into electrical energy. Power source 210 may, in another example, be a wind-power electric generator; in yet another example, power source 210 may be a fuel cell. Other independent power sources are possible and are contemplated as being within the scope of this disclosure. As well, power source 210 may be a plurality of independent power sources, such as, for example, multiple fuel cells or solar panels with a fuel cell.

Power system 200 may further include, in one example, an energy storage system 230. An energy storage system 230 may be included to ensure that a source of electric power may be available to refrigeration system 130 when power source 210 is not available to provide power. For example, energy storage system 230 may be a battery; if, for example, power source 210 is one or more photovoltaic panels, the battery 230 may ensure that power is available to operate refrigeration system when weather precludes power generation from the sun. In one preferred embodiment, energy storage system 230 is a rechargeable battery; the battery may be recharged, for example, from excess power generated by power source 210 not needed for operating refrigeration system 130. Energy storage system 230 may also be a plurality of batteries connected together, as a way of providing power for longer periods of time, if necessary. One exemplary embodiment of energy storage system 230 comprises a plurality of hybrid capacitor-batteries. Hybrid capacitor-batteries may provide additional advantages to a cold-storage unit over conventional batteries, as these hybrids generally provide power at a slower rate, and therefore expend less wasted power when a refrigeration system begins drawing power from the hybrids. Alternative types of energy storage systems may also be possible.

Power system 200 may also include, in another example, a power inverter 220. A power inverter 220 may be necessary if, for example, power source 210 provides electrical energy in one form of electrical current, such as a form of direct current, and one or more components of refrigeration system 130 are designed to operate optimally on a different form of electrical current, such as an alternating current. In such examples, power inverter 220 may be used to convert the type of electrical current provided by power source 210 and/or energy storage unit 230 into another type of electrical current usable by one or more components of refrigeration system 130.

FIG. 2A also illustrates one possible embodiment of a switch 245 connected to a thermostat 240. A thermostat may generally be disposed within the interior space of a cold storage unit to detect the temperature inside the unit. When the temperature inside the cold storage unit rises to or above a set threshold, switch 245 is designed to automatically complete a circuit connection between power system 200 and refrigeration system 130 along connection 160. While the temperature of the cold storage unit remains below the set threshold, switch 245 remains in an "off" position so that power does not flow to refrigeration system 130. Thermostat 240 may be powered by power source 210, an internal battery, or by other means as desired.

Figure 2B:
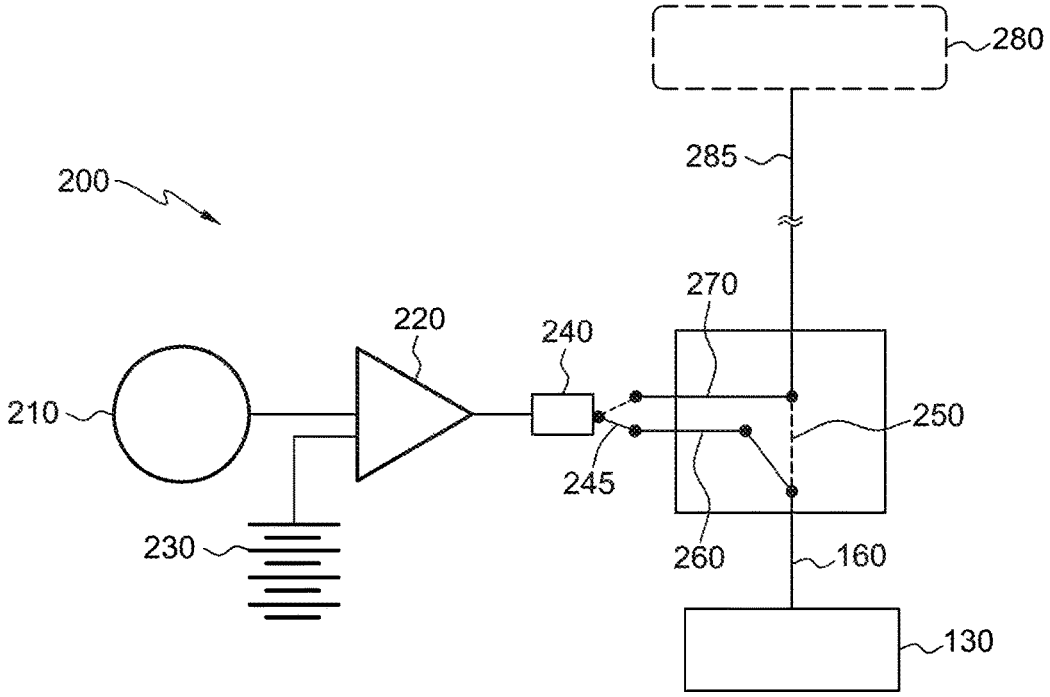
FIG. 2B depicts another embodiment of a power system connected to a refrigeration system, in which the refrigeration system and power system are also connected to an external power grid, in accordance with one or more aspects of the present invention.

FIG. 2B provides a schematic illustration of another embodiment of a power system 200 connected to a refrigeration system 130 of a cold storage unit as described herein, in which power system 200 and refrigeration system 130 are further connected to an external power grid 280. In this embodiment, power system 200 is designed to generally provide power to refrigeration system 130, and external power grid 280 is further connected via, for example, a transfer switch 250 to provide power to refrigeration system 130 when power system 200 cannot, such as in circumstances when power source 210 may be in need of repair or replacement. As described in a previous embodiment, power system 200 includes a power source 210, which may be one or more types of independent power sources, such as photovoltaic panels, fuel cells, or other type of power source. Also as described in a previous embodiment, power system 200 may further include an energy storage system 230, for example a battery or a plurality of batteries, that may provide power when power source 210 is unavailable, and further may provide power when external grid 280 is unable to supply power to refrigeration unit 130, such as during extended power outages.

In this embodiment, power system 200 may further include a power inverter 220. Power inverter 220 may be used, for instance, to convert direct current supplied by power source 210 into alternating current, which may then be used to power one or more components of refrigeration system 130 that are designed to operate on alternating electrical current. Refrigeration system components designed to operate on alternating current may be preferred in this or similar embodiments, where power grid 280 generally supplies electrical power in the form of alternating current. Such components may also provide additional energy efficiency advantages to further facilitate reducing the amount of energy drawn from external grid 280 and from power source 210.

FIG. 2B further depicts a portion of an embodiment of a transfer switch 250, which may be used to facilitate automatically switching between power system 200 and external power grid 280 to supply power to refrigeration system 130, and to further allow sending power from power source 210 to external grid 280 to facilitate reducing the net energy drawn from external power grid 280, ideally to a net of zero energy drawn from external power grid 280. As similarly described in a previous embodiment, a thermostat 240 with a first switch 245 may be used to detect the temperature of the interior of a cold storage unit. Thermostat 240 may then automatically flip first switch 245 to provide power to refrigeration system 130 via connections 260, 160 when a set temperature threshold is reached or exceeded; when the temperature is below this threshold, or possibly below a separately set second threshold temperature, thermostat 240 may flip first switch 245 to connect power system 200 with connections 270, 285 to external power grid 280, permitting power to flow from power system 200 out to external power grid 280. Transfer switch 250 may add a second switch 255 that is capable of switching between connections 260 and 285, depending on whether power system 200 is capable of supplying power to refrigeration system 130. When power system 200 is available and able to provide sufficient power to refrigeration system 130 to operate, second switch 255 facilitates a connection between connections 260 and 160, allowing power system 200 to operate refrigeration system 130 while connection 285 to external power grid 280 may remain inactive. In circumstances when power system 200 is unable to supply sufficient power to refrigeration system 130, second switch 255 may automatically switch to make a connection between connections 285 and 160, allowing power to flow from external power grid 280 to refrigeration system 130. In such an arrangement, the net energy drawn from external power grid 280 may be calculated as the difference between the actual energy drawn from external power grid 280 and the energy supplied back to external power grid 280 by power system 200. Ideally, this net energy may be zero, or even possibly less.

Figure 3:
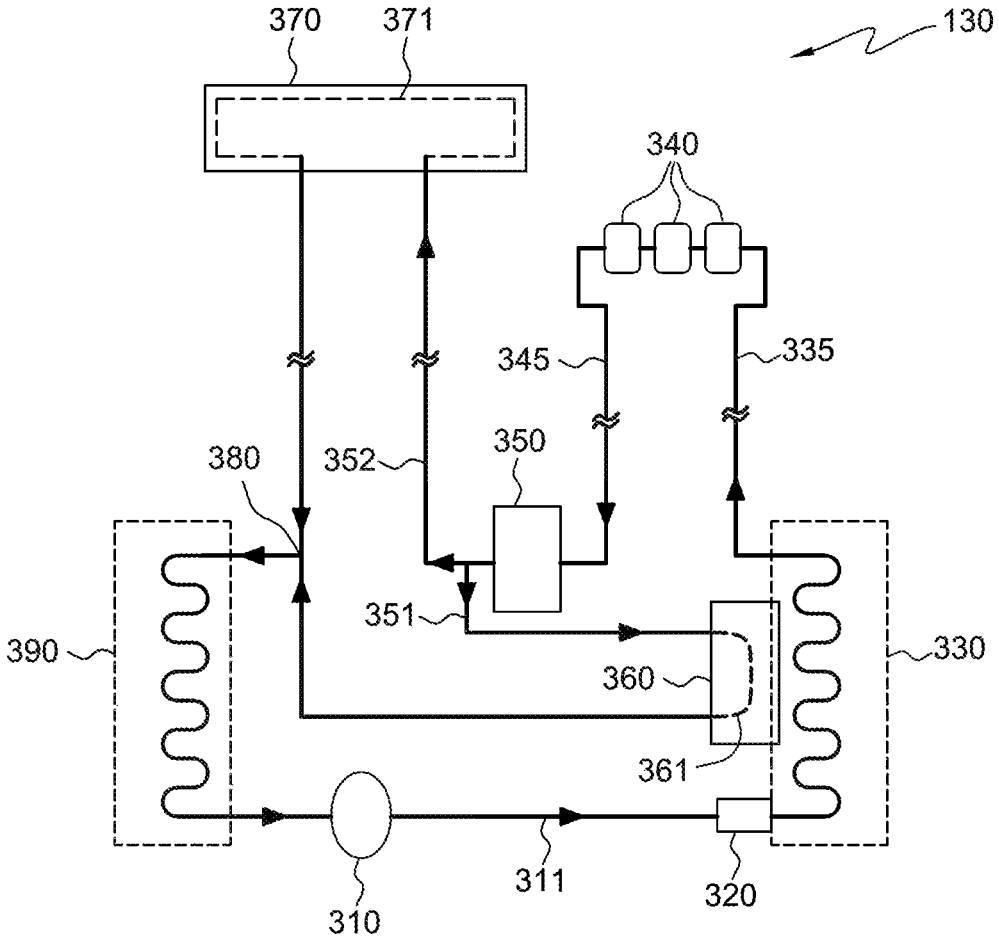
FIG. 3 depicts a schematic diagram of an embodiment of a refrigeration system that includes additional components for using the refrigerant from the refrigeration system to defrost one or more components of the cold storage unit, and for using the refrigerant to freeze material inside cold plate containers, in accordance with one or more aspects of the present invention.

FIG. 3 provides a schematic illustration of an embodiment of a refrigeration system 130 that includes components for diverting heated refrigerant to one or more components of a cold storage unit to prevent those components from freezing and icing, as well as additional components for facilitating maintenance of a desired internal temperature of the cold storage unit and reducing electrical power consumption by the refrigeration system. A liquid refrigerant tank 310 provides a reservoir for liquefied refrigerant. When refrigeration system 130 components operate, liquid refrigerant flows out of tank 310 along a connection to an evaporator 330, the connection conveying the refrigerant in the general flow direction 311 indicated. Flow of the refrigerant into evaporator 330 may be regulated by a solenoid valve 320. As refrigerant flows into evaporator 330, the refrigerant evaporates and the vapor pressure of the refrigerant drops, which also drops the temperature of the refrigerant. The cold vapor refrigerant inside the evaporator absorbs heat from air inside the cold storage unit; this reduced temperature air is circulated within the cold storage unit by an evaporator fan (not separately depicted). The refrigerant, still in a cold vapor state, is conveyed out of evaporator 330 by a suction line 335 to one or more containers 340 disposed elsewhere in the cold storage unit, for example, in one or more sides or a ceiling of the cold storage unit. The one or more containers 340 contain a freezable material, as well as an internal tube (not separately depicted) through which the cold vapor refrigerant is conveyed; as the refrigerant passes through an internal tube of a container, the freezable material within the container surrounding the internal tube may freeze. The one or more containers 340 may be disposed such that they are in thermal contact with air inside the cold storage unit, so as to allow heat to transfer from the warmer air to the container. For example, containers 340 may be preferably disposed within a ceiling of the cold storage unit, such that the containers are in physical contact with a surface of the ceiling that faces the interior space of the cold storage unit. Thus, as warmer air circulates upward toward the ceiling above the interior space, it comes in contact with the cold surface of the ceiling, the surface made cold by the frozen material in containers 340; heat then may transfer from the air to the containers, and the colder air may circulate back through the interior space. This system may thus facilitate maintenance of a desired internal temperature of the cold storage unit and may reduce the frequency of operation of refrigeration system 130, thereby reducing the net amount of power drawn by refrigeration system 130.

After the refrigerant has exited the one or more containers 340, it travels back via a connection 345 to a compressor 350. The compressor 350 compresses the vaporized refrigerant, maintaining it in vapor form but heating it to a higher temperature. This compressed and heated gas is conveyed out of the compressor by a plurality of tubes 351, 352 to one or more components of the cold storage unit. One or more of the plurality of tubes may be a metal tube, such as copper tubing, in which the outer material of the tube promotes heat conduction. The plurality of tubes may be insulated along one or more portions in order to prevent heat from conducting away from the tubes in unwanted areas. One of the plurality of tubes 351 may, for example, convey heated refrigerant gas to a drain pan 360 that may be part of evaporator 330. Drain pan 360 collects condensed moisture that may from on and drip from the evaporator 330, and may further be connected to a drainage tube (not separately depicted) to remove moisture from the drain pan. Drain pans commonly require heat to prevent moisture from freezing inside the drain pan, as may occur inside freezer units. In this example, a portion of tube 361 carries heated refrigerant vapor along a side or inside drain pan 360; the refrigerant heat conducts via the tube to the drain pan to prevent freezing of moisture. Another of the plurality of tubes 352 may, for instance, convey heated refrigerant gas to an entry frame 370. Entry frames for freezer units may require heating to prevent a door from freezing to the frame, as may occur when moisture from an external environment accumulates on the frame and comes in contact with the freezing temperature of the interior of the cold storage unit. In this example, a portion of tube 371 conveys heated refrigerant vapor along or around entry frame 370, so that heat conducts via metal tube 371 to the frame and prevents moisture from freezing to the frame. Including such a system of conveying heated refrigerant to other components of the cold storage unit may eliminate the need for alternative means of defrosting such components that depend on additional electric power. For example, many conventional cold storage units make use of electric tape to defrost entry frames, drain pans, and so on, and such electric tape must draw electric power, aside from the power used for a refrigeration system, to adequately defrost these components. Eliminating such additional power draws may reduce the net energy needed to operate a cold storage unit as described herein.

Finally, heated refrigerant vapor from other components of the cold storage unit is conveyed back to a common tube 380 and then to a condenser 390. Condenser 390 generally includes a fan (not separately depicted) for blowing cool air over a refrigerant tube or coil inside condenser 390, cooling the refrigerant and allowing it to return it to a liquid state. The liquefied refrigerant returns to liquid refrigerant tank 310. Thus, the refrigerant of refrigeration system 130 may be used not only to reduce the temperature of air inside the cold storage unit, but may also be used to freeze material inside containers for better temperature maintenance, and further used to defrost components of the cold storage unit, without using additional electric power to run such systems. This facilitates achieving a cold storage unit, designed to maintain internal temperatures below the freezing point of water, that operates on reduced power and that is capable of operating ideally at a net zero energy draw from an external power grid, or entirely independently from an external power grid.

Figure 4:
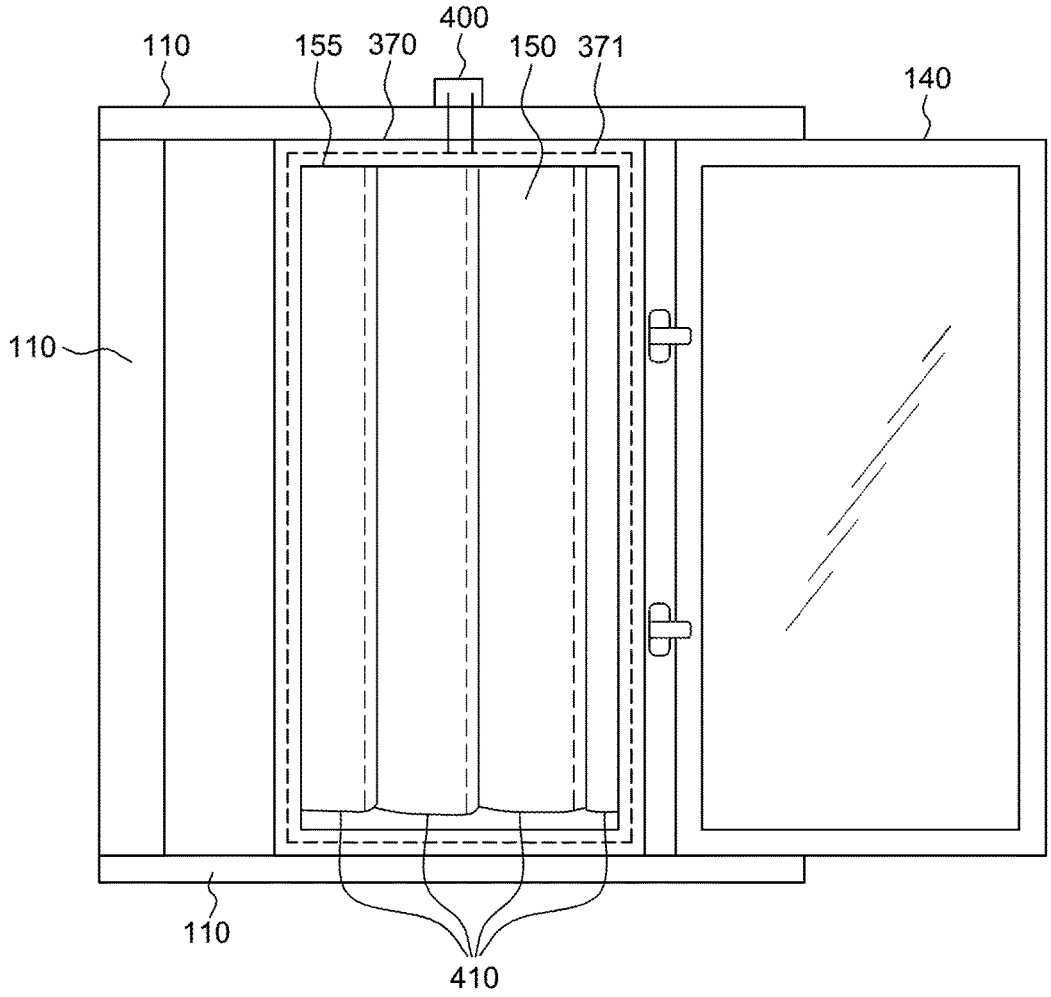
FIG. 4 depicts a front-view of an embodiment of a cold storage unit, displaying a portion of components for defrosting an entry frame of the cold storage unit, in accordance with one or more aspects of the present invention; and, FIG. 5 depicts a cut-away top view of a portion of an embodiment of a refrigeration system, in which components of the refrigeration system are connected to a series of cold plate containers disposed in one side of the cold storage unit, in accordance with one or more aspects of the present invention.

FIG. 4 further depicts a portion of an embodiment of one of the plurality of tubes 371 used to convey heated refrigerant vapor, for example, to an entry frame 370 supporting an openable barrier 140. Tube 371 may, for example, be disposed outside one of the sides 110 of a cold storage unit to convey heated refrigerant vapor from a refrigeration system to entry frame 370, and may further be insulated by an insulation housing 400 to prevent the heated vapor inside tube 371 from dissipating heat as it is conveyed to door frame 370. Tube 371 may, for instance, be routed around the entirety of entry frame 371, as depicted in FIG. 4, such that all sides of entry frame 370 receive heat. Tube 371 may be disposed on the exterior of entry frame 370 or may, as depicted here by the dashed lines, be disposed inside entry frame 370. Openable barrier 140, here depicted by way of example as an insulated door, may thus be prevented from freezing to entry frame 370. FIG. 4 further depicts, for illustrative purposes, one example of a second openable barrier 150, here a series of overlapping PVC strips 410.

Figure 5:
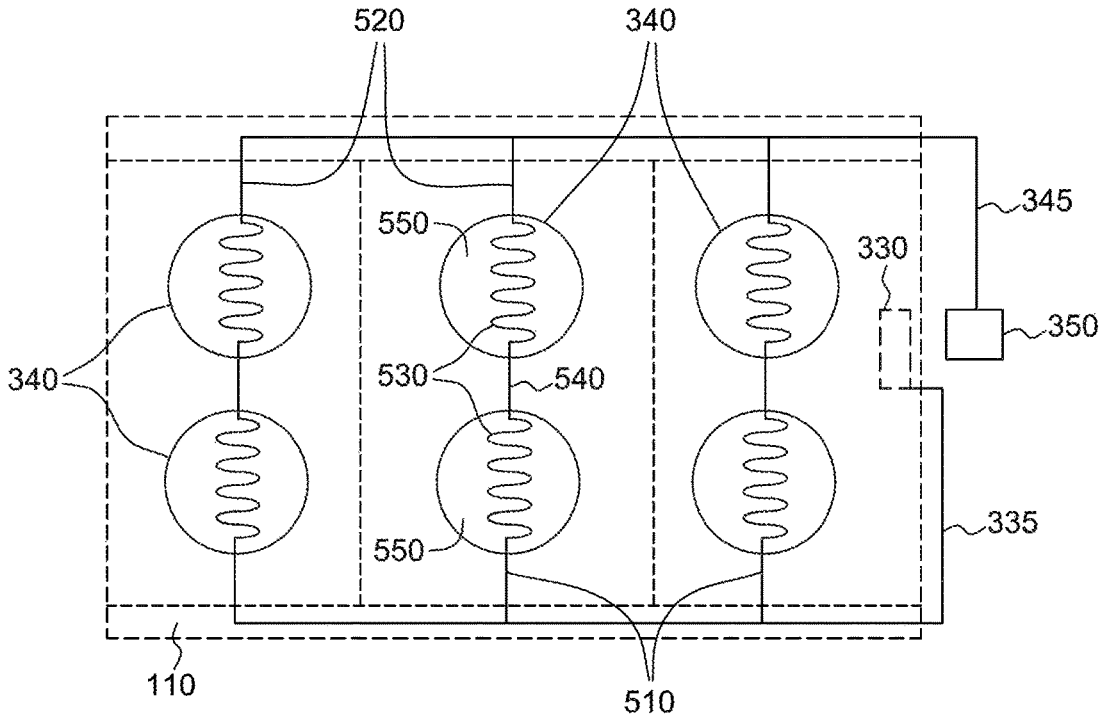

FIG. 5 further depicts a cut-away top view of an embodiment of the one or more containers 340 used to facilitate maintenance of a desired internal temperature of a cold storage unit. In this example, several containers 340 are disposed within an insulated side 110 of the cold storage unit, preferably the side forming the ceiling of the cold storage unit. As similarly described above, an evaporator 330 is connected to a suction line 335 through which cold refrigerant flows to the several containers 340. Additional connection tubes 510 may branch from suction line 335 to connection suction line 335 with the several containers 340. Each of the several containers 340 has an inner tube 530 through which refrigerant may flow, and a freezable material 550 is contained within each of the several containers 340, such that freezable material 550 is in thermal contact with inner tube 530. As refrigerant flows from connection 510 through tube 530 and out to a separate connection 540, heat from freezable material 550 transfers to the refrigerant, dropping the temperature of freezable material 550; as cold refrigerant continues to flow and heat continues to transfer, the freezable material 550 may eventually freeze solid. In one example, where multiple containers are connected in series, refrigerant may flow through separate connection 540 to another inner tube 530 of another container, where the refrigerant may again transfer away heat from a freezable material 550. Refrigerant flows out of containers 340 to exit connections 520, and may then flow into return line 345 which conveys refrigerant to a compressor 350 of a refrigeration system.

Additional features to reduce the net energy used by a cooler or freezer unit may be added in one or more embodiments of the cold storage units described above. For example, in some geographic locations or environments, the average climate may be such that the external environment temperature frequently is similar to the desired interior space temperature of a cooler unit, that is, around 32° F. to 40° F. In such environments, one or more closeable vents may be disposed in one or more sides of the cooler unit. At times when the external temperature is greater than the desired temperature for the interior space of the cold storage unit, the vents may be shut and the refrigeration system may run as needed to maintain the desired interior temperature. At other times, when the external temperature matches the desired interior space temperature, the vents may be opened to allow the external air to naturally cool the interior of the cold storage unit, and the refrigeration system need not operate. Such vents may be further be connected to an external thermostat or thermometer, so that the vents may be automatically opened or shut according to the external environment temperature.

The terminology used herein is for the purpose of describing particular examples only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include (and any form of include, such as "includes" and "including"), and "contain" (and any form of contain, such as "contains" and "containing") are open-ended linking verbs. As a result, a method or device that "comprises," "has," "includes" or "contains" one or more steps or elements possesses those one or more steps or elements, but is not limited to possessing only those one or more steps or elements. Likewise, a step of a method or an element of a device that "comprises," "has," "includes" or "contains" one or more features possesses those one or more features, but is not limited to possessing only those one or more features.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable or suitable. For example, in some circumstances, an event or capacity can be expected, while in other circumstances the event or capacity cannot occur—this distinction is captured by the terms "may" and "may be."

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

What is claimed is:

1. An apparatus comprising:

a cold storage unit capable of being connected to a power grid, comprising:

a refrigeration system;

a box enclosing an interior space, the box comprising a plurality of insulating sides, the insulating sides minimizing heat transfer and moisture transfer to the interior space from an external environment, the plurality of insulating sides providing insulation of rating about R-68 or greater;

an entry into the interior space comprising a plurality of openable barriers, the plurality of barriers facilitating preventing entry of heat or moisture into the interior space from the external environment;

a power system connected to the refrigeration system, the power system facilitating independent operation of the refrigeration system when not connected to the power grid, and further facilitating a net energy use of zero from the power grid when connected to the power grid; and a plurality of tubes facilitating conveyance of a refrigerant within said refrigeration system to a drain pan, the drain pan facilitating collecting and removing moisture from an evaporator, and wherein the refrigerant facilitates preventing freezing of moisture in the drain pan.

2. The apparatus of claim 1, wherein the plurality of openable barriers comprises at least a first barrier and a second barrier, the first barrier providing a barrier between the interior space and an exterior environment and the second barrier being disposed within the interior space.

3. The apparatus of claim 1, wherein the power system comprises a power source designed to generate electrical energy and current.

4. The apparatus of claim 3, wherein the power system further comprises an energy storage system, the energy storage system being capable of supplying electrical energy to the refrigeration system when the power source is not providing electrical energy to the refrigeration system.

5. The apparatus of claim 4, wherein the energy storage system comprises a rechargeable battery.

6. The apparatus of claim 3, wherein the electrical current provided by the power source is a first type of electrical current, and wherein the power system further comprises a power inverter, the power inverter facilitating conversion of the first type of electrical current into a second type of electrical current.

7. The apparatus of claim 6, further comprising a transfer switch, the transfer switch facilitating a connection between the power inverter and the external power grid, the transfer switch further facilitating controlling supplying power to the refrigeration system from the power system and the external power grid.

8. The apparatus of claim 7, wherein the transfer switch further facilitates supplying power from the power system to the external power grid.

9. The apparatus of claim 1, wherein the cold storage unit is a cooler designed to maintain a temperature of at least or above 32° F. within the interior space.

10. The apparatus of claim 1, the apparatus further comprising:

the plurality of tubes further facilitating conveyance of the refrigerant to one or more other components of the cold storage unit, the refrigerant facilitating defrosting of the one or more components of the cold storage unit; and at least one container comprising an enclosed volume and a freezable material, the container facilitating maintaining a below-freezing temperature within the interior space.

11. The apparatus of claim 10, wherein the refrigeration system further comprises a compressor, the compressor facilitating heating of the refrigerant and being connected to the plurality of tubes, wherein the plurality of tubes further facilitate conveyance of the refrigerant heated by the compressor from the compressor to the one or more components of the cold storage unit.

12. The apparatus of claim 11, wherein the refrigeration system further comprises the evaporator.

13. The apparatus of claim 12, wherein one of the one or more components of the cold storage unit is an entry frame, the entry frame supporting at least one of the plurality of openable barriers, and wherein the refrigerant heated by the compressor facilitates preventing the one of the plurality of openable barriers from freezing to the entry frame.

14. The apparatus of claim 10, wherein the refrigeration system further comprises the evaporator and a compressor, and wherein the at least one container further comprises an inlet port and an outlet port on an exterior surface of the at least one container and an interior tube connecting said ports, the interior tube facilitating conveyance of the refrigerant from the evaporator through the at least one container to the compressor.

15. The apparatus of claim 14, wherein facilitating maintaining a below-freezing temperature within the interior space comprises using the refrigerant conveyed by the interior tube to freeze the freezable material within the container, and the frozen material within the container facilitating cooling of air within the interior space.

16. The apparatus of claim 15, wherein the refrigeration system further comprises the compressor, the compressor facilitating heating of the refrigerant and being connected to the plurality of tubes, wherein the plurality of tubes further facilitate conveyance of the refrigerant heated by the compressor from the compressor to the one or more components of the cold storage unit.

17. The apparatus of claim 16, wherein one of the one or more components of the cold storage unit is the drain pan, the drain pan facilitating collecting and removing moisture from the evaporator, and the refrigerant heated by the compressor facilitating preventing the freezing of the moisture within the drain pan, and wherein another of the one or more components of the cold storage unit is an entry frame, the entry frame supporting at least one of the plurality of openable barriers, and wherein the refrigerant heated by the compressor facilitates preventing the one of the plurality of openable barriers from freezing to the entry frame.

18. The apparatus of claim 17, wherein the power system further comprises: a power source designed to generate electrical energy and current; an energy storage system, the energy storage system being capable of supplying electrical energy to the refrigeration system when the power source is not providing electrical energy to the refrigeration system; a power inverter; and a transfer switch, the transfer switch facilitating a connection between the power inverter and the external power grid, the transfer switch further facilitating controlling supplying power to the refrigeration system from the power system and the external power grid.

19. The apparatus of claim 18, wherein the plurality of openable barriers comprises at least a first barrier and a second barrier, the first barrier providing a barrier between the interior space and an exterior environment and the second barrier being disposed within the interior space.

20. The apparatus of claim 19, wherein the cold storage unit is a freezer designed to maintain a temperature within the interior space below 32° F.

* * * * *